US006602035B1

(12) United States Patent
Parker

(10) Patent No.: US 6,602,035 B1
(45) Date of Patent: Aug. 5, 2003

(54) FASTENER WITH HINGED-CLAMPING ELEMENT

(75) Inventor: Gary Parker, Stonehouse (GB)

(73) Assignee: Springfast Limited, Gloucester (GB)

( * ) Notice: Subject to any disclaimer, the term of this patent is extended or adjusted under 35 U.S.C. 154(b) by 0 days.

(21) Appl. No.: 09/936,659

(22) PCT Filed: Mar. 15, 2000

(86) PCT No.: PCT/GB00/00954

§ 371 (c)(1),
(2), (4) Date: Feb. 27, 2002

(87) PCT Pub. No.: WO00/55437

PCT Pub. Date: Sep. 21, 2000

(Under 37 CFR 1.47)

(30) Foreign Application Priority Data

Mar. 16, 1999 (GB) ..... 9905876
Feb. 16, 2000 (GB) ..... 0003438

(51) Int. Cl.[7] ..... F16B 21/00; F16B 23/00

(52) U.S. Cl. ..... 411/340; 411/400; 411/433; 411/437

(58) Field of Search ..... 411/340, 344, 411/345, 400, 433, 437

(56) References Cited

U.S. PATENT DOCUMENTS 2,916,235 A * 12/1959 Nagel ..... 411/340 X
4,502,826 A * 3/1985 Fafard ..... 411/340
5,871,320 A * 2/1999 Kovac ..... 411/433 X

* cited by examiner

*Primary Examiner*—Neill Wilson
(74) *Attorney, Agent, or Firm*—Young & Thompson

(57) ABSTRACT

A fastener for receiving a sink unit in a worktop has a plastics clip for attaching to a tab or rail and a hinged clamping member (11) which is tightened up against the underside of the worktop by a screw. The screw can be pressed through a bore in the hinge pin and self-tap into a non-threaded passage in the clip when the clamping member is hinged to engage under the worktop. The bore through the hinge pin has small flexible tags projecting into it past which the screw thread can snap, but which retain the screw when that is not engaged with the clip. The hinge pin and the clip have mutually engageable detents which locate the pin, and thus the clamping member, in either the operative position, for engaging the worktop, or the non-operative position with the clamping member swung back free of the worktop.

10 Claims, 3 Drawing Sheets

FASTENER WITH HINGED-CLAMPING ELEMENT

BACKGROUND OF THE INVENTION

This invention relates to fasteners. It is primarily concerned with fasteners for sinks or basins which are set down into an aperture in a worktop, the rim being a flange that rests on the periphery of the aperture and which is clamped in place by devices fitting underneath the sink or basin.

DESCRIPTION OF THE RELATED ART

The invention is a development of the fastener described in our Patent EP-B-0128772.

That fastener has a clip for attachment to a rail and a hinged clamping member which is tightened up against the underside of the worktop by a screw. This threads through the hinge pin, and when undone allows the clamping member to swing back to and stay in an inoperative position where it will clear the edge of the hole of the worktop as the unit is lowered in. Doing up the screw causes the clamping member to swing and project a portion under the worktop. The clamping member has guide fingers which engage diametral slots in the ends of the hinge pin.

SUMMARY OF THE INVENTION

We have now developed a plastics clip to replace the metal one of earlier models and this allows for some improvements. In particular, reliance now does not now have to be placed entirely on the hinge pin for engagement by the screw, and more certain operative and non-operative positions for the clamping element can be held. In particular, when swinging the clamping element into the ready-to-use operative position, correct alignment for the arms of the clamping element to move upwardly can be automatically obtained.

According to one aspect of the present invention there is provided a fastener for holding basins or sinks in worktops, the fastener comprising a clip for engagement with a formation on the underside of the basin or sink adjacent the periphery thereof, a clamping element hinged by a pin to the clip to be engageable under the worktop or to be swung clear thereof when the basin or sink is positioned therein, and a screw engaged through the pin and with the clamping element by which that element can be urged upwardly, wherein the aperture in the pin is not screw threaded but has at least one flexible tag for co-operating with the screw thread, whereby the screw can be retained by pressing it axially into the aperture for the tag to snap over at least one turn of its screw thread, and wherein the clip is of plastics material and presents a non-threaded bore into which the screw self-taps when the fastener is tightened.

Preferably, several tags, for example four, are regularly spaced circumferentially of the aperture Thus, all the pin does, apart from providing the facility for hinging, is to hold the screw lightly, and the load when clamping is completed is taken by the engagement between the screw and the bore in the clip.

According to another aspect of the present invention there is provided a fastener for holding basins or sinks in worktops, the fastener comprising a clip for engagement with a formation on the underside of the basin or sink adjacent the periphery thereof, a clamping element hinged by a pin to the clip to be engageable under the worktop or to be swung clear thereof when the basin or sink is positioned therein, and a screw engaged through the pin and with the clamping element by which that element can be urged upwardly, the clamping element having guide fingers parallel to the screw and engaged in diametral slots in the ends of the pin, wherein the clip in which the hinge pin is journalled is of plastics material, and the pin and clip have mutually co-operating detents which allow the pin to rotate but which register the pin in two positions, one the operative position for the clamping element engaged under the worktop with the slots in the ends of the pin upright and the other the non-operative position with the pin rotated to a position where the clamping element is swung clear of the worktop.

Conveniently, the detents are angularly spaced recesses in the pin and a projection into the cylindrical bore through the plastics clip which receives the pin. This projection will be small, sufficient to snap into either recess and positively locate the parts, but small enough to be snapped out again and not to impede rotation significantly.

Preferably, one recess is a groove parallel to the axis of the pin and joining the end slots. There may be two other recesses, symmetrically positioned on either circumferential side of that groove. Only one will actually be used, but it is convenient to have two since it then does not matter which way around the pin is entered.

Instead of the guide fingers merely co-operating with a face of the clip as in EP-B-0128772, the clip preferably has grooves to receive those fingers when the pin is in the operative position.

These aspects of the invention may be combined in a single fastener.

For a better understanding of the invention, one embodiment will now be described, by way of example, with reference to the accompanying drawings, in which.

Figure 5:
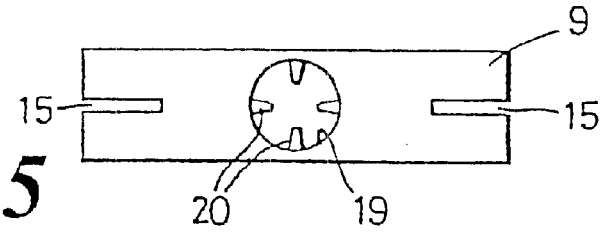
Figure 6A:
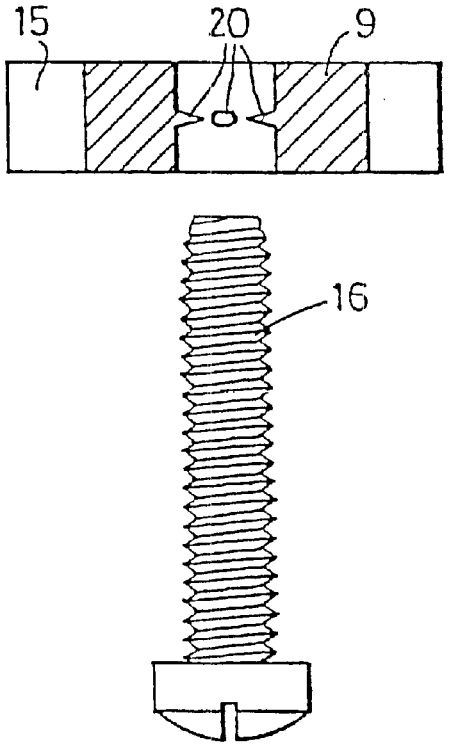
Figure 6B:
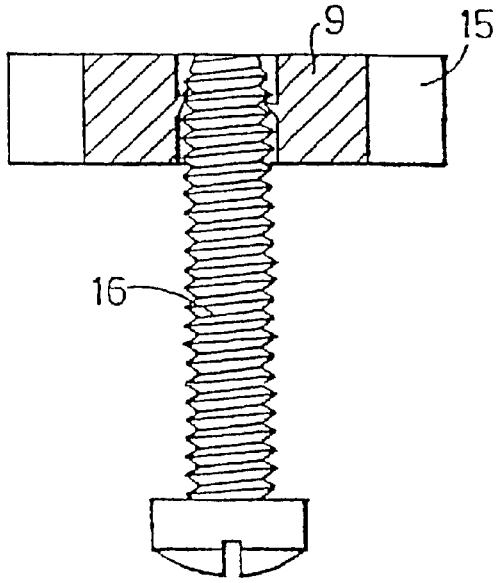
Figure 7:
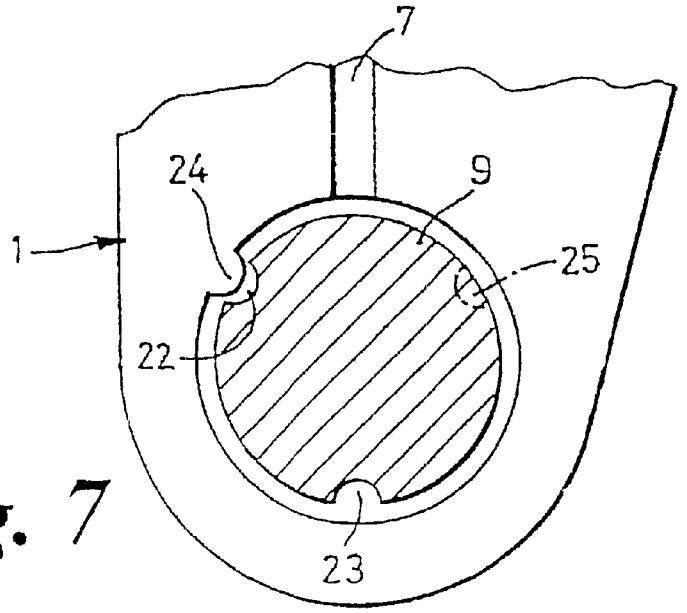

FIGS. 4(*a*)–4(*f*) illustrate, in steps, how the fastener is attached to a sink;

FIG. 5 shows a hinge pin used in the fastener;

FIGS. 6(*a*)–6(*b*) show the pin in axial section with the engagement of a screw, and FIG. 7 is a cross-section through the hinge pin and the surrounding part of the fastener.

DESCRIPTION OF THE PREFERRED EMBODIMENTS

The upper part of the fastener is a clip 1 integrally moulded in plastics material. It is generally square in face view, and on its front face, centrally at the top, there is a hooked lug 2. Lower down there is an upwardly projecting tongue 3 generally parallel to the main body of the clip but being capable of outward flexure. This hook and tongue arrangement enables the clip to be secured to a tab or rail 4 projecting downwardly from just inside the rim 5 of a sink, the tab or rail having an aperture into which the lug 2 can engage. The fitting sequence is illustrated in FIGS. 4(*a*)–4(*f*).

On the rear face of the clip, the central portion 6 is thickened and this enables two grooves 7 to be formed in opposite vertical edges. It also provides for a smooth bore 8 parallel to and mid-way between those grooves. At the lower end, the clip has a transverse bore for receiving a hinge pin 9, but on the rear face corner portions 10 are cut away to allow hinging of a clamping member 11 as described below.

This clamping member 11 is similar to the one described in our Patent No. EP-B-0128772. It is generally L-shaped in side view with a stepped lower flange 12 having upturned corners 13 for engaging under a worktop. The upright portion comprises two fingers 14 which engage in diametral slots 15 in opposite ends of the hinge pin 9 and which can be guided up the grooves 7. A screw 16 has its head 17 engaging under a central lug 18 at the root of the flange 12 and extends upwardly parallel to and mid-way between the fingers 14.

Referring now to FIG. 5, the aperture 19 through the pin 9 is not threaded, but has a plain bore other than four small tags 20 equispaced around and projecting into the bore. They are integrally moulded with the plastics pin, and are small and thin enough to be flexible. As shown in FIGS. 6(*a*)–6(*b*), the screw can simply be pushed into the aperture, and the tags 21 will snap over the crests of the thread to retain the screw. There could be fewer tags, and indeed just one might suffice.

Figure 1:
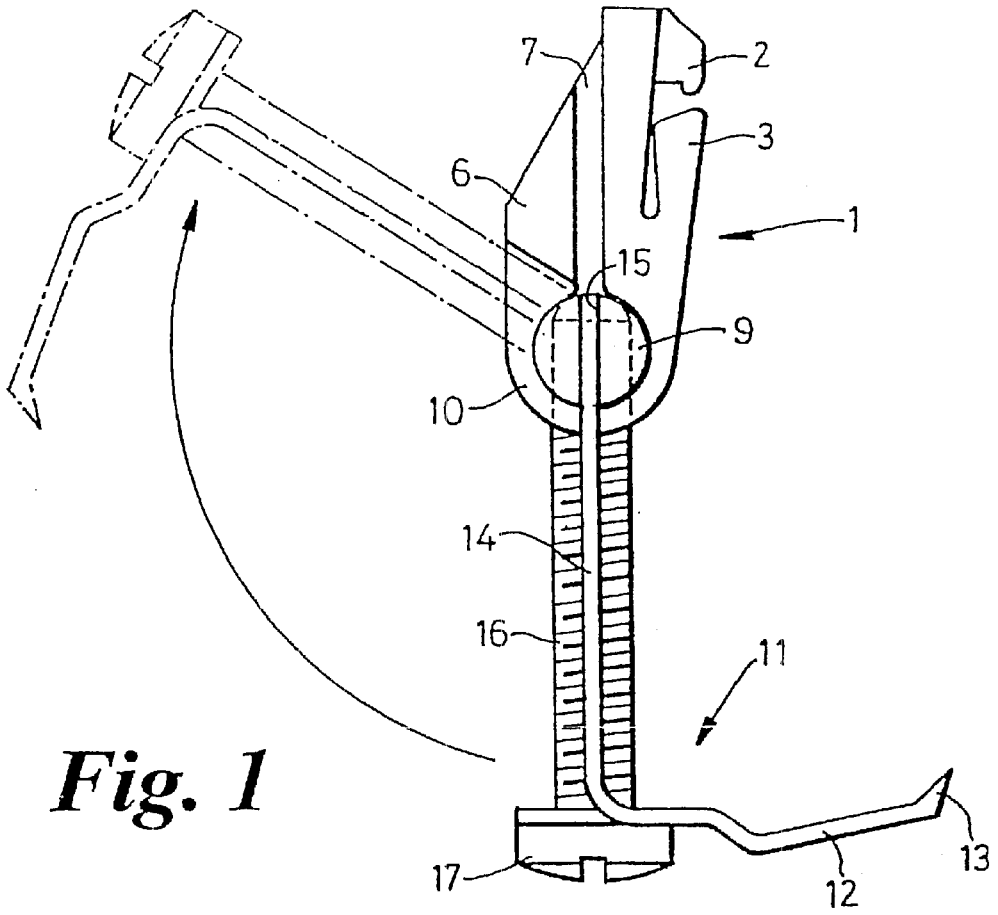
FIG. 1 is a side elevation of a hinged fastener for sinks.
Figure 2:
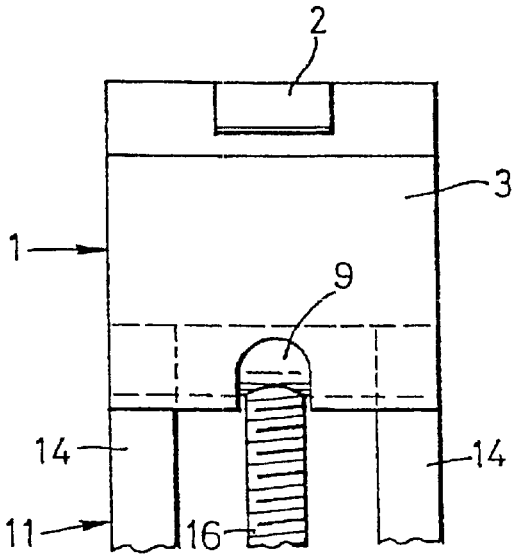
FIG. 2 is a front view of the fastener of FIG. 1.
Figure 3:
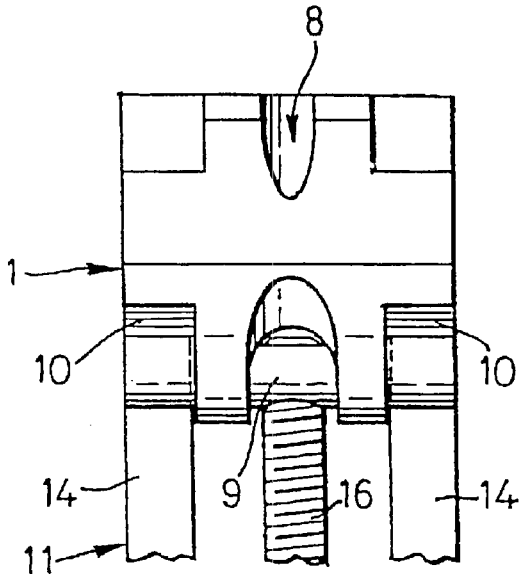
FIG. 3 is a rear view of the fastener of FIG. 1.
Figure 4A:
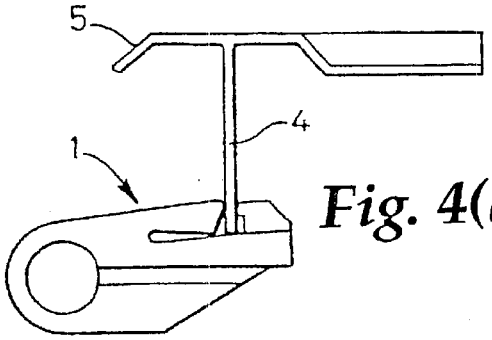
Figure 4B:
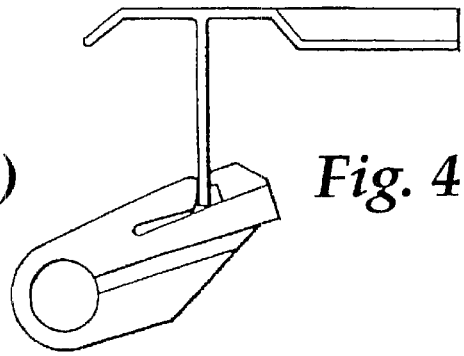
Figure 4C:
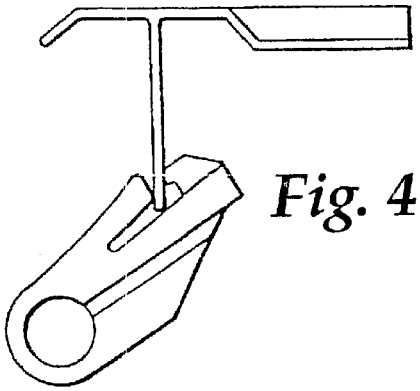
Figure 4D:
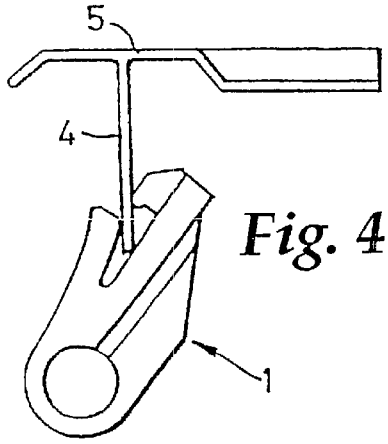
Figure 4E:
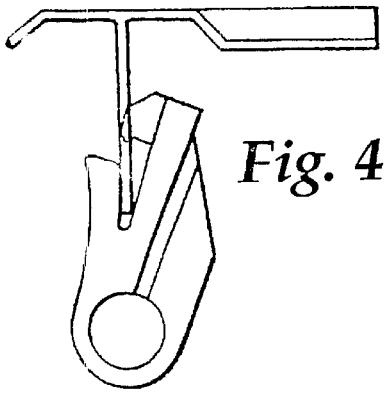
Figure 4F:
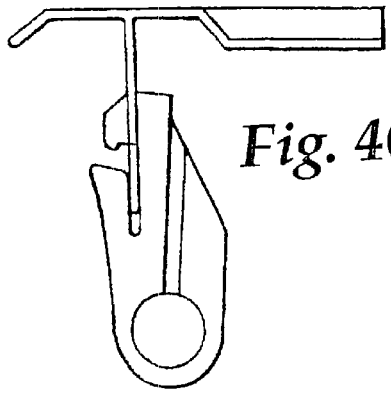

Referring now to FIG. 7, the pin 9 has axially parallel grooves 22 and 23 spaced circumferentially through an arc of about 120°. One of these grooves 23 may be aligned with the end slots 15 and join them, although being interrupted by one mouth of the aperture 19. The other groove 22 will be just offset from the other mouth of the aperture 19 through the pin. The bore of the clip 1 in which the pin is entered has a small rib 24, and this can positively engage in either groove 22 or 23. But while it will impose some frictional resistance on rotation of the pin, it will not stop it. Thus, the pin can be positively located in either of two positions, one being with the arms 15 aligned with the grooves 7 and the other with the clamping element swung well out of the way as indicated in broken lines in FIG. 1.

There can be a third groove 25 in the pin 9, as indicated in outline in FIG. 7, which would allow the pin to be put in either way around.

For use, the fastener is fitted to the sink and the latter lowered into place with the clamping member 11 swung out of the way and held by the rib 24 and groove 23. Then the clamping member is rotated back so that its fingers 14 are vertical, this being ensured by engagement of the rib 24 and the groove 22. Such rotation cannot be achieved, as in EP-B-0128772, by driving the screw and thus forcing the tips of the fingers 14 to engage the clip 1 and wedge the clamping member 11 into the worktop engaging position. However, the clamping member just requires a tap with a screwdriver to snap it from one located attitude to the other. Finally, the screw is driven up and self-taps into the bore 8, the fingers 14 being guided by the grooves 7.

What is claimed is:

1. A fastener for holding basins or sinks in worktops, the fastener comprising a clip (1) for engagement with a formation on the underside of the basin or sink adjacent the periphery thereof, a clamping element (11) hinged by a pin (9) to the clip (1) to be engageable under the worktop or to be swung clear thereof when the basin or sink is positioned therein, and a screw (16) engaged through a diametral aperture (19) in the pin (9) and with the clamping element (11) by which that element can be urged upwardly, characterised in that the aperture (19) in the pin is not screw threaded but has at least one flexible tag (20) projecting from the wall of the aperture perpendicularly to the axis thereof for co-operating with the screw thread, whereby the screw (16) can be retained by pressing it axially into the aperture (19) whichever of two opposite ways the pin is presented for the tag (20) to snap over at least one turn of its screw thread, and in that the clip (1) is of plastics material and presents a non-threaded bore (8) into which the screw (16) self-taps when the fastener is tightened.

2. A fastener as claimed in claim 1, characterised in that there is a plurality of tags (20) regularly spaced circumferentially of the aperture (9).

3. A fastener for holding basins or sinks in worktops, the fastener comprising a clip (1) for engagement with a formation on the underside of the basin or sink adjacent the periphery thereof, a clamping element (11) hinged by a pin (9) to the clip (1) to be engageable under the worktop or to be swung clear thereof when the basin or sink is positioned therein, and a screw (16) engaged through the pin (9) and with the clamping element (11) by which that element can be urged upwardly, the clamping element (11) having guide fingers (14) parallel to the screw (16) and engaged in diametral slots (15) in the ends of the pin, characterised in that the clip (1) in which the hinge pin (9) is journalled is of plastics material, and the pin (9) and clip (1) have mutually co-operating detents (22,23,24) which allow the pin (9) to rotate but which register the pin (9) in two positions, one the operative position for the clamping element (11) engaged under the worktop with the slots (15) in the ends of the pin (9) upright and the other the non-operative position with the pin (9) rotated to a position where the clamping element (11) is swung clear of the worktop.

4. A fastener as claimed in claim 3, characterized in that the clip (1) has grooves (7) to receive the guide fingers (14) when the pin (9) is in the operative position.

5. A fastener as claimed in claim 3, characterised in that the detents are angularly spaced recesses (22,23) in the pin (9) and a projection (24) into the cylindrical bore through the plastics clip (1) which receives the pin (9), the projection (24) having snap engagement with either recess (22,23).

6. A fastener as claimed in claim 5, characterized in that the clip (1) has grooves (7) to receive the guide fingers (14) when the pin (9) is in the operative position.

7. A fastener as claimed in claim 5, characterised in that one recess (22) is a groove parallel to the axis of the pin (9) and joining the end slots (15).

8. A fastener as claimed in claim 7, characterized in that the clip (1) has grooves (7) to receive the guide fingers (14) when the pin (9) is in the operative position.

9. A fastener as claimed in claim 7, characterised in that there are two other recesses, symmetrically positioned on either circumferential side of the groove.

10. A fastener as claimed in claim 9, characterized in that the clip (1) has grooves (7) to receive the guide fingers (14) when the pin (9) is in the operative position.

* * * * *